US007540265B2

(12) United States Patent
Girard

(10) Patent No.: US 7,540,265 B2
(45) Date of Patent: Jun. 2, 2009

(54) VALVE ACTUATING DEVICE

(75) Inventor: Didier Girard, Courdimanche (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 299 days.

(21) Appl. No.: 11/569,420

(22) PCT Filed: May 19, 2005

(86) PCT No.: PCT/FR2005/050345

§ 371 (c)(1),
(2), (4) Date: Nov. 20, 2006

(87) PCT Pub. No.: WO2005/112543

PCT Pub. Date: Dec. 1, 2005

(65) Prior Publication Data

US 2008/0163834 A1 Jul. 10, 2008

(30) Foreign Application Priority Data

May 19, 2004 (FR) ..... 04 50999

(51) Int. Cl.
*F01L 9/04* (2006.01)

(52) U.S. Cl. ..... 123/90.11; 123/90.66; 123/90.16; 251/129.01

(58) Field of Classification Search ..... 123/90.11, 123/90.66, 90.16; 251/129.01, 129.15, 129.16
See application file for complete search history.

(56) References Cited

U.S. PATENT DOCUMENTS 5,804,962 A 9/1998 Kather et al.
6,418,892 B1 7/2002 Donce et al.
6,768,406 B1 7/2004 Fiaccabrino et al.
2003/0217714 A1 * 11/2003 Yoeda et al. ..... 123/90.11

FOREIGN PATENT DOCUMENTS

| | | | |
|---|---|---|---|
| DE | 19506566 | A1 | 8/1996 |
| DE | 19631909 | A1 | 2/1997 |
| EP | 1357264 | A | 10/2003 |
| FR | 2714998 | A | 7/1995 |
| WO | WO 00/61922 | A | 10/2000 |
| WO | WO 00/65203 | A | 11/2000 |

OTHER PUBLICATIONS

International Search Report mailed Oct. 14, 2005 in PCT/FR2005/050345.

* cited by examiner

*Primary Examiner*—Zelalem Eshete
(74) *Attorney, Agent, or Firm*—Nicholas E. Seckel

(57) ABSTRACT

The invention relates to an actuating device that actuates at least one valve pair (1) of an internal combustion engine, housed inside a housing (2) comprising, for each valve (1), magnetizing means (4, 5), at least one spring (6) that acts upon the valve (1), and comprising a fixed end connected to an adjustable stop (16), and a moving end connected in a translatory manner to the valve (1), the adjustable stop (16) comprising meshing means (26) that can interact with mating meshing means (8) of a control element (10) whereby adjusting the tare of the spring (6). The invention is characterized in that the control element (10) is placed in a fixed manner inside the housing (2) next to the adjustable stops (16) of the two valves (1) of the same pair. The housing (2) comprises means for selectively guiding and positioning the control element (10) in two meshing positions respectively with the two adjustable stops (16).

15 Claims, 5 Drawing Sheets

VALVE ACTUATING DEVICE

Figure 1:
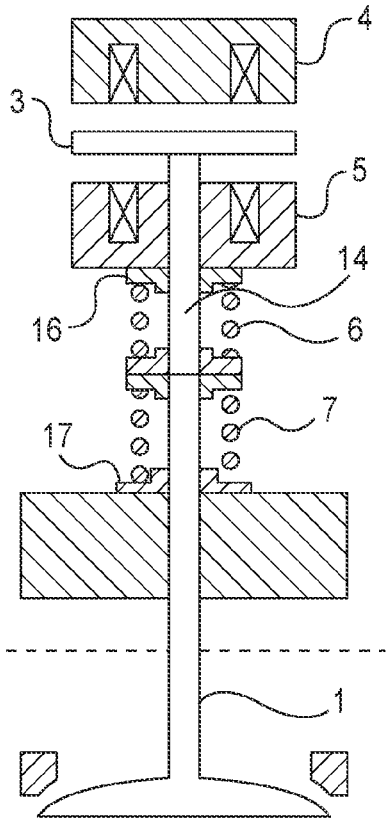

The invention concerns a valve actuating device.

The invention concerns more particularly a device for actuating at least one pair of valves of an internal combustion engine disposed in a housing of the type comprising, for each valve, magnetizing means, at least one spring that acts on the valve toward an equilibrium position and comprising a fixed end made integral with an adjustable stop and a movable end made integral in translation with the valve, the adjustable stop comprising meshing means adapted to cooperate with mating meshing means of a control element to enable the stop to move with respect to the housing, so as to adjust the tare of the spring.

Such a device is described in the document WO0065203A1. To perform the adjustment of the tare of the valve springs, the device described in this document uses a tool introduced between two adjacent valve actuators. The tool is constituted by a rod equipped at its end with a disc portion whose border has a toothed sector. The toothed sector of the tool is designed to mesh with a toothed wheel whose rotation controls the movement of a movable equipment integral with one end of a spring.

However, the adjustment of the tare of a spring according to this device is difficult. Indeed, the tool must be introduced with a certain orientation in the device, to enable the toothed sector to penetrate inside the device. The tool is then moved laterally toward the toothed wheel of the movable equipment associated to a spring. The toothed sector must then be brought blindly into a position in which it meshes with the toothed wheel. In this position which is difficult to reach, the toothed sector can be set in rotation to perform the adjustment of the tare of the spring. When the springs of two adjacent valves must be adjusted, the tool which has performed the adjustment of a first spring must then be moved laterally to mesh with the adjacent toothed wheel according to the same procedure.

The structure of such a valve control device requires thus complex adjustment operations which are hardly compatible with a large-scale industrial production. In addition, the complexity of the operations required for the adjustment of the tare of the springs is susceptible to causing adjustment errors.

An objective of the present invention is to remedy all or part of the drawbacks of the prior art as described above.

To this effect, the actuating device according to the invention, otherwise conform to the generic definition given in the preamble above, is essentially characterized in that the control element is placed in a permanent manner in the housing in a manner adjacent to the adjustable stops of the two valves of a same pair, the housing comprising means for guiding and positioning the control element selectively in two positions meshing with the two adjustable stops, respectively.

Further, the invention can comprise one or more of the following characteristics:

- the two adjustable stops of a pair of valves are located in distinct planes shifted in a direction of a main movement of the control element,
- the device comprises means for blocking the control element in a deactivated position preventing the movement of an adjustable stop,
- the deactivated position corresponds to a simultaneous meshing of the control element with the two adjustable stops of a pair of valves,
- the blocking means of the element comprise a movable axle in the housing adapted to cooperate with the body of the control element,
- the control element is mounted in a sliding manner in the housing,
- the sliding direction of the control element is substantially parallel to the direction of the movements of the valves,
- the stop and the control element cooperate by meshing during the respective rotationw, and when the control element is in a meshing position, the respective rotation axes of the stop and the control element are substantially parallel,
- the stop comprises a threaded ring mounted on the outside thread of a sleeve equipped with meshing means, the sleeve being mounted free in rotation and blocked in translation with respect to the housing, the threaded ring being blocked in rotation with respect to the housing, so that the rotation of the sleeve causes the movement of the threaded ring along said sleeve,
- the sleeve has a general shape of a cylindrical tube, an end of which comprises a flange, and the meshing means are formed on the flange,
- the guiding and positioning means comprise elastic means that act on the control element toward one of the meshing positions,
- the control element comprises a body in the shape of a rod and a toothed wheel formed in the area of one of the ends of the body,
- the control element has an end substantially flush with a face of the housing and comprising means for coupling with an adjustment element,
- the device comprises, for each valve, a paddle made integral in translation with the valve rod, the paddle being disposed between two magnetizing means, the device comprising also two antagonistic springs acting on the valve/paddle group toward an equilibrium position.

Figure 2:
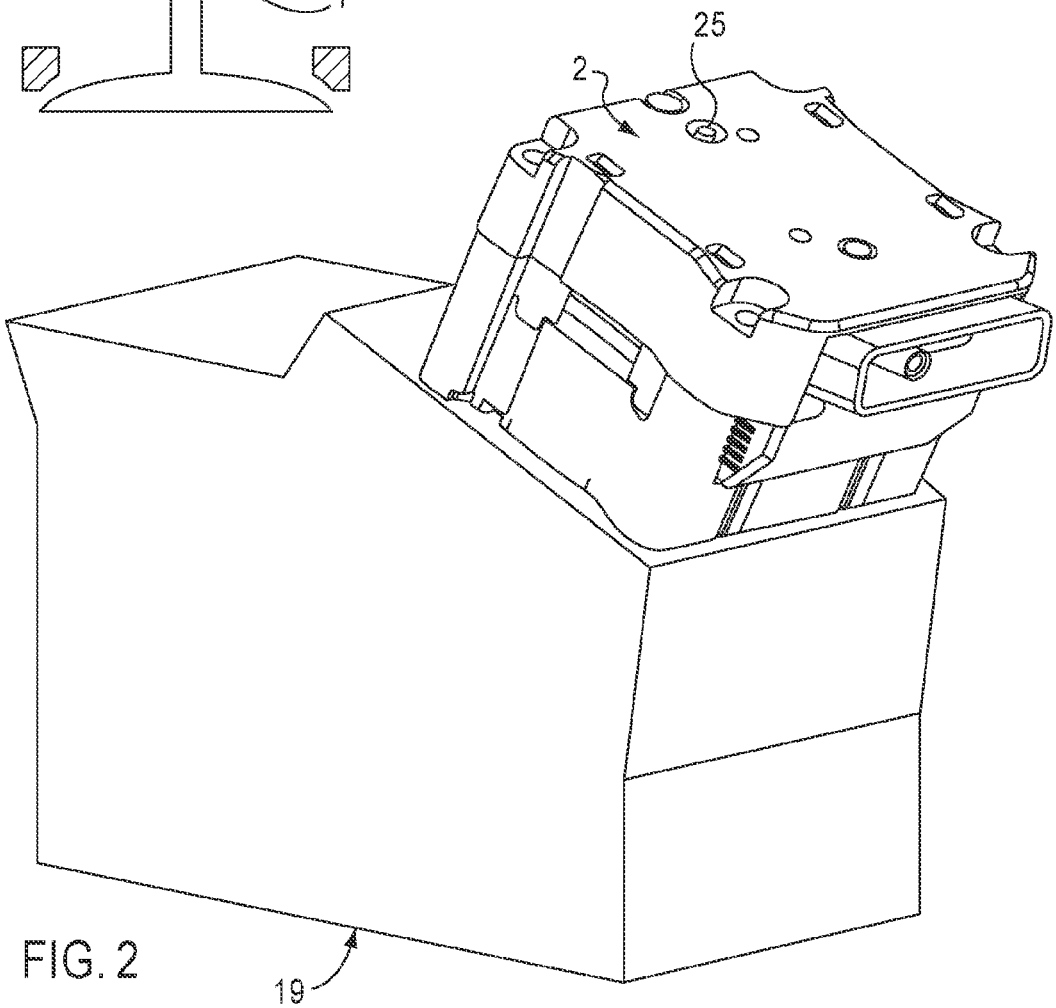
Figure 3:
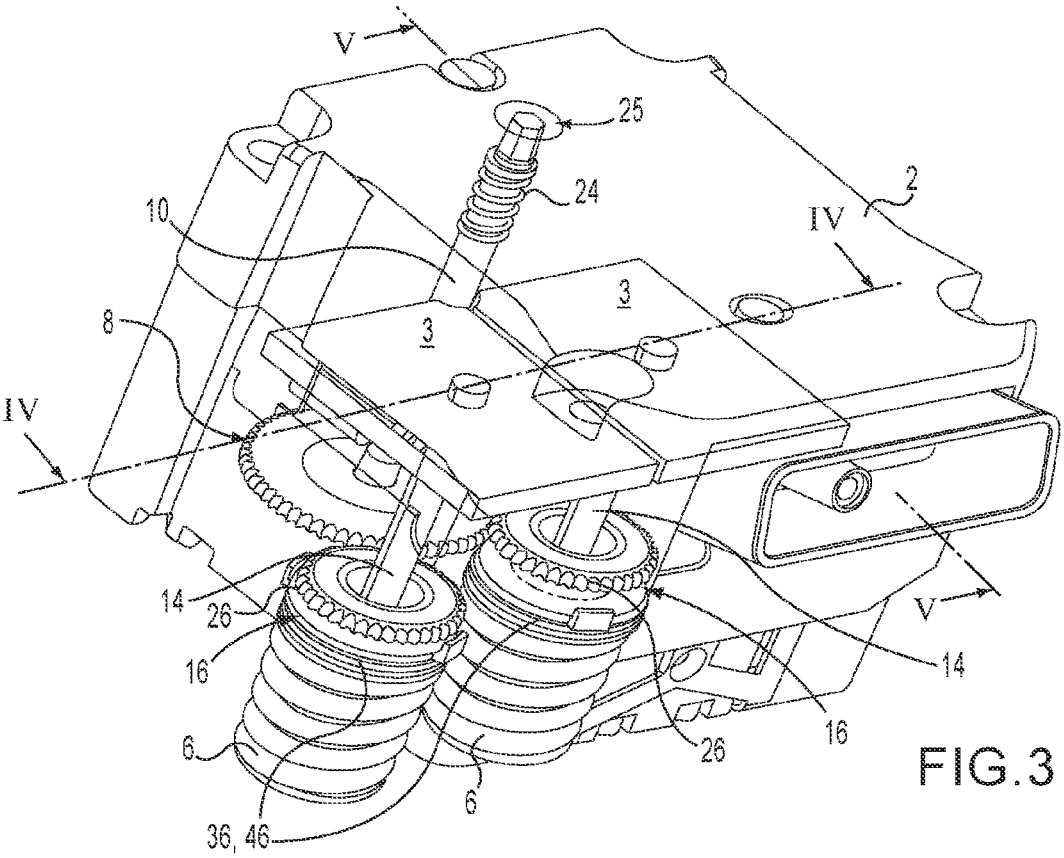
Figure 4:
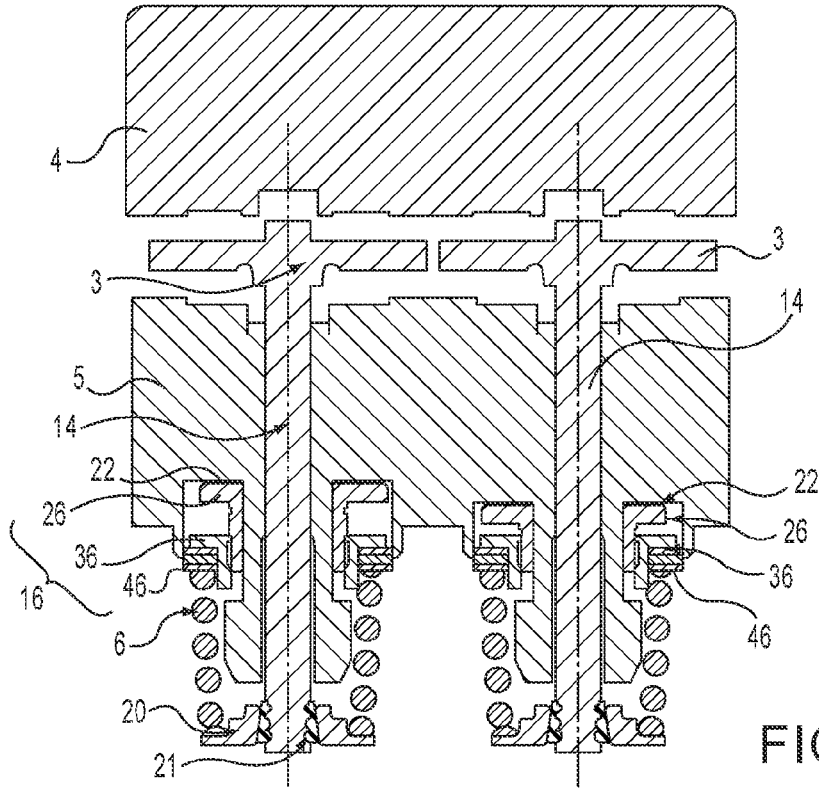

Other particularities and advantages will appear upon reading the following description made in reference to the Figures in which:

FIG. 1 is a schematic longitudinal cross-section view of an electromagnetic valve to which the invention can be applied, FIG. 2 is a perspective view illustrating schematically a valve actuating device according to the invention, mounted on a cylinder head of an internal combustion engine, FIG. 3 is a perspective view showing schematically a portion of the arrangement of a device for actuating a pair of valves according to the invention, FIG. 4 is a vertical cross-section view of a portion of the actuating device according to line IV-IV of FIG. 3.

Figure 5:
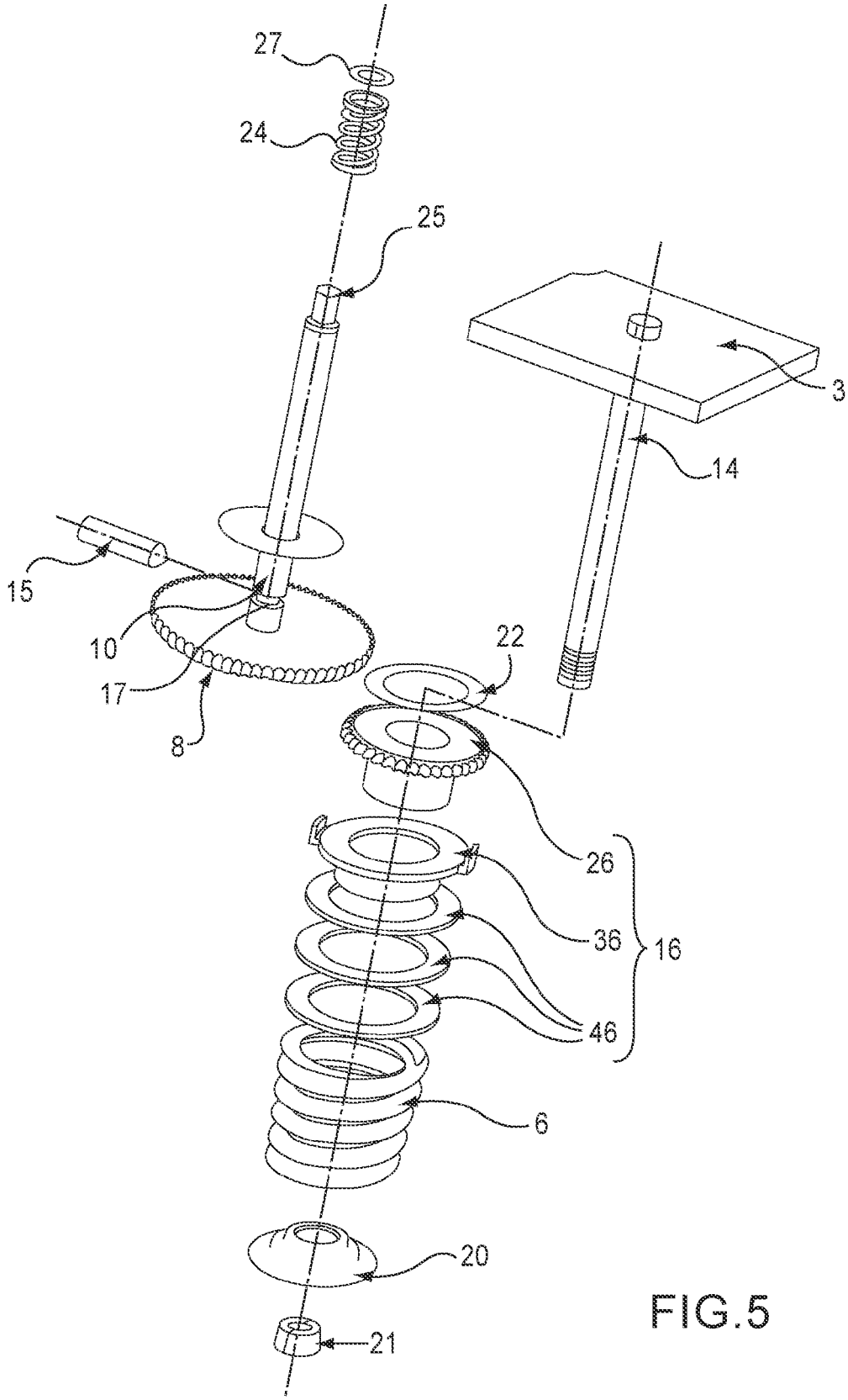
Figure 6:
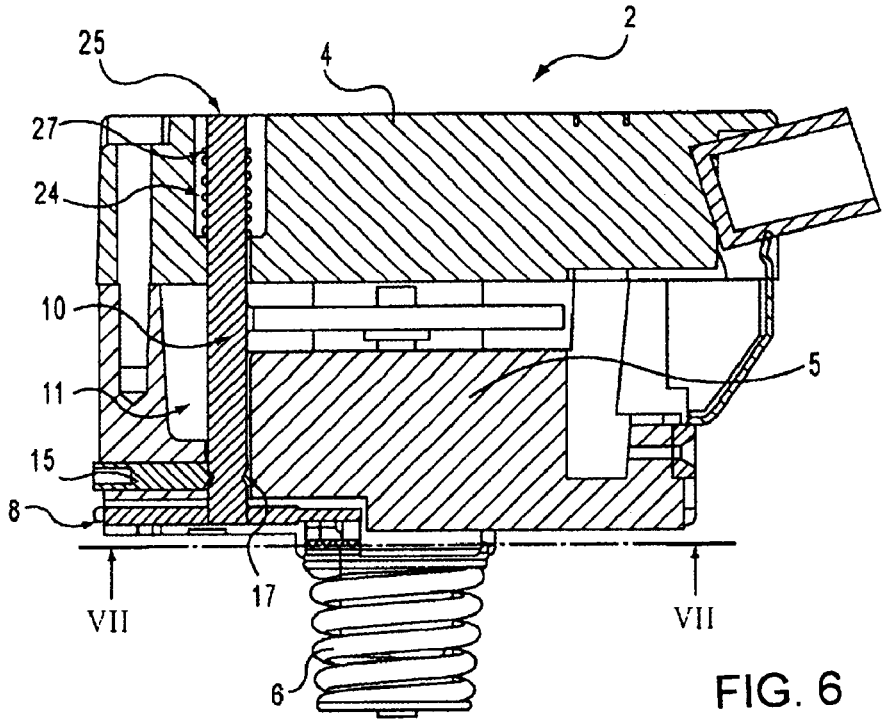
Figure 7:
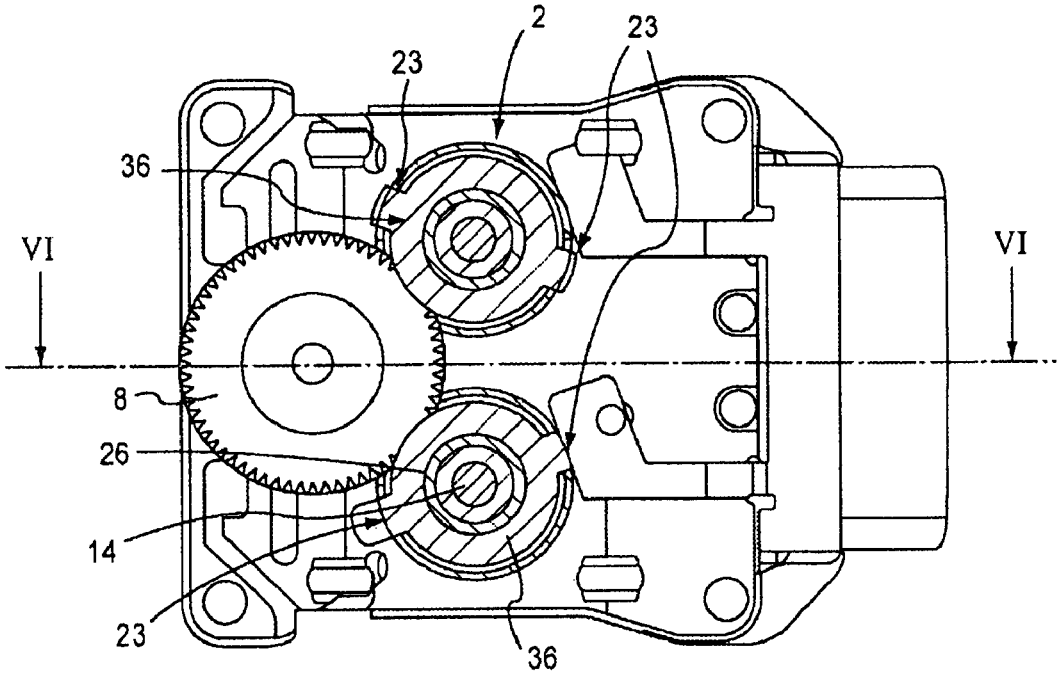
Figure 8:
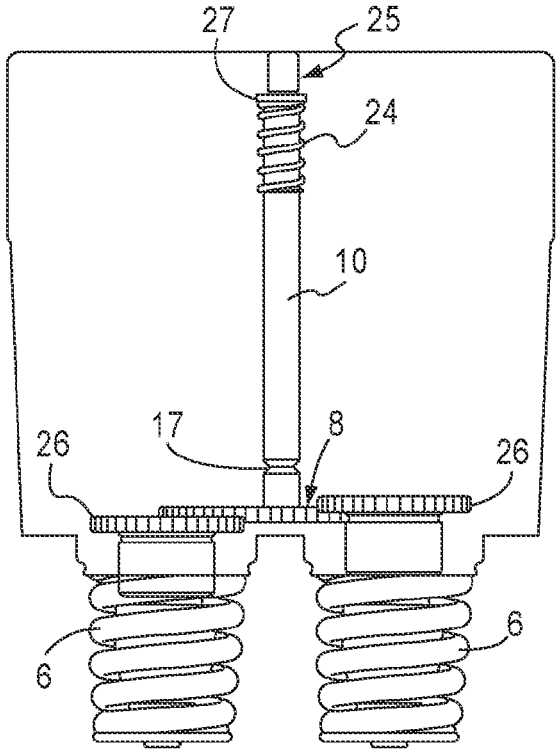
Figure 9:
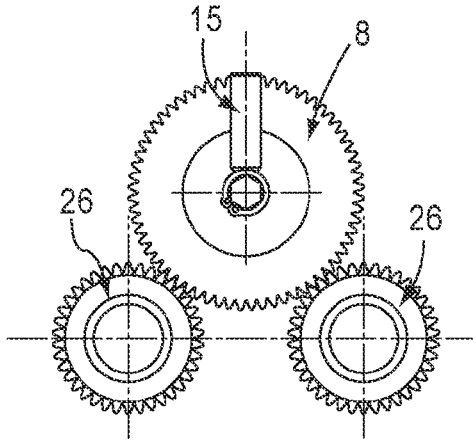
Figure 10:
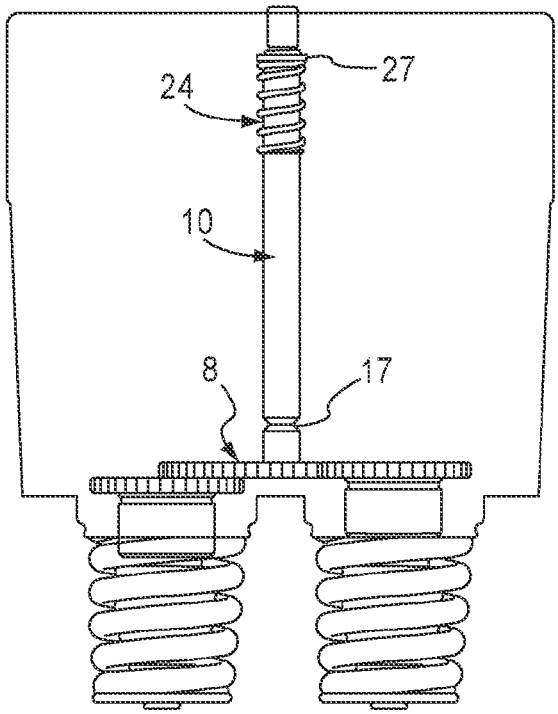

FIG. 5 is an exploded perspective view of a portion of the actuating device of FIGS. 3 and 4, illustrating a portion of the control mechanism of one of the two valves, FIG. 6 is a cross-section view of the device according to line DD of FIG. 3 or according to line VI-VI of FIG. 7, FIG. 7 is a horizontal cross-section view of the device according to line VII-VII of FIG. 6, FIG. 8 is a side view of a portion only of the device of FIG. 3 in a first operating position, FIG. 9 is a top view of the arrangement of FIG. 8, FIG. 10 is a view analogous to that of FIG. 8, in a second operating position.

The invention applies to valves of an internal combustion engine which are actuated in an electromagnetic manner. FIG. 1 illustrates an example of an actuator of such a valve called "electromagnetic valve." The actuator comprises classically a movable part constituted by a rod 14, an end of which is integral with a paddle 3 disposed between two electromagnets 4, 5 (see also FIG. 4). The other end of the movable rod 14 is supported on the end of the rod of the valve 1.

Two springs, upper spring 6 and lower spring 7, are mounted in an antagonistic manner on the rod/valve group 14, 1 so as to act on the group toward an equilibrium position (position shown on FIG. 1). Each of these springs 6, 7 comprises a fixed end made integral with a fixed stop and a movable end made integral in translation directly or indirectly with the valve and/or the movable rod 14. The paddle 3 is subjected to the action of the electromagnets 4, 5, so as to move and block the valve 1 in open or closed position. The paddle 3 and the valve 1 can be balanced by the springs 6, 7 between the two, open and closed, positions. The tare of the springs 5, 6 must be adjusted so that, when the electromagnets 4, 5 are not activated, the valve 1 and the paddle 3 are disposed in the equilibrium position between the open and closed positions.

In general, only one of the two springs 6 associated to the valve 1 has an adjustable tare, to make it possible to equalize its tare with that of the other spring 7.

As shown on FIG. 2, the control mechanism of the valves 1 is generally integrated into a housing 2 called "actuator" which is mounted directly or indirectly on the cylinder head 19 of an internal combustion engine.

FIGS. 3 and 4 show a portion of the mechanism of FIG. 1. For simplification purposes, elements identical to those described above are designated with the same reference numerals and will not be described in detail a second time.

As shown on FIGS. 4 and 5, the upper spring of the mechanism has a first movable lower end which is made integral with the movable rod 14 by means of a lower cup 20 and a conical coupling device 21. The upper end of the spring 6 is made integral with a support washer 46 comprising, for example, three rings (see FIG. 5). The support washer 46 is itself mounted on a threaded ring 36 screwed on the outside thread of a cylindrical sleeve 26.

The sleeve 26 is mounted free in rotation and blocked in translation with respect to the housing 2. More precisely, the sleeve 26 comprises at its upper end a flange supported on the body of the actuator (electromagnet 5, for example) via a support washer 22. Teeth are formed on the outside border of the flange of the sleeve 26 (see FIG. 5 in particular).

The threaded ring 36 is blocked in rotation with respect to the housing 2. For example, as shown on FIG. 7, the threaded ring 36 comprises shoulders which engage into recesses in the body of the housing 2 and prevent the rotation of the ring 36 around its axis.

According to this arrangement, the rotation of the sleeve 26 causes the movement of the threaded ring 36 toward the length of said sleeve 26. The direction of movement of the threaded ring 36 along the length of the sleeve 26 is determined by the direction of rotation of the sleeve 26.

The group constituted by the sleeve 26, the threaded ring 36 and the support washer 46 forms an adjustable stop 16 for the upper end of the spring 6, as described in more details below.

The teeth of the sleeve 26 are designed to cooperate with a complementary threading of a control element 10 which has preferably an oblong shape. To this effect, the housing 2 comprises a receptacle 11 for the element 10 located in the proximity of the adjustable stops 16 of the two valves 1 of a same pair of valves.

The control element 10 comprises, for example, a body in the shape of a rod and a toothed wheel 8 formed in the area of one of the ends of the body. The control element 10 is preferably disposed in a permanent manner in the housing 2. The receptacle 11 of the housing 2 is shaped in order to guide the control element 10, so as to enable its movement selectively into two positions meshing with the two adjustable stops 16, respectively.

The stops 16 and the control element 10 cooperate by meshing during their respective rotations. Preferably, the respective rotation axes of the stop 16 and of the control element 10 are substantially parallel.

The control element 10 is mounted in a sliding manner into the housing 2 along the direction of the longitudinal symmetry axis of its body. In addition, this sliding direction of the control element 10 is preferably parallel to the directions of the movement of the movable rods 14 supported on the valves 1.

The receptacle 11 for the control element 10 opens on a face of the housing 2 so as to enable the end of the element 10 located at the opposite end with respect to the toothed wheel 8 to come flush with the outside of the housing 2. This flush end of the control element 10 has coupling means 25, such as an appropriate recess or protrusion which enables coupling it to an outside adjustment element (not shown). The adjustment element can be, for example, a socket or a wrench which is operated manually by an operator or by a robot.

Advantageously, the two adjustable stops 16 of the pair of valves 1 are located in two distinct planes, respectively, shifted along a main direction of the movement of the control element 10 (see FIG. 4).

As shown on FIG. 8, the toothed wheels of the two adjustable stops 16 can be located in two distinct planes which are shifted slightly along the direction of movement of the control element 10. A slight shift of the toothed wheels as described above makes it possible to dispose the control element 10 in a third position, called deactivated position, in which the control element 10 meshes at the same time with the two adjustable stops 16 of a pair of valves 1. In this configuration, the rotation of the stops and of the element 10 is "self-blocked."

Means 15, 17 for blocking the control element 10 in the deactivated position can be provided. As shown on FIGS. 6 and 9, in particular, these blocking means can comprise a center pop screw 15 mounted in a threaded hole of the housing 2 and whose end is adapted to come into engagement with a conjugated groove 17 formed on the body of the control element 10.

Elastic means such as a spring 24 can also be mounted on the control element 10 so as to act on the latter toward one of the meshing positions. For example, the spring 24 is slipped on the body of the control element 10 and has an end supported on a circlip 27 mounted on this same body of the element 10. The other end of the spring can come to be supported on a shoulder formed by the receptacle 11 for the element 10 inside the housing 2.

The operation of the embodiment whose structure has been described above will now be explained.

During its assembly, the actuator 2 can be disposed so that the control element is blocked in its deactivated position. I.e., the body of the control element is blocked by the center pop screw 15 so that the toothed wheel 8 of the control element 10 meshes with the two adjustable stops at the same time (position shown on FIG. 8).

If it is necessary to adjust the tare of a first spring, for example, the spring 6 located on the right on FIG. 10 (on the left on FIG. 4), an operator can unscrew the center pop screw 15 to release the control element 10. When the center pop screw 15 does no longer form a block for the control element 10, the latter is moved automatically toward the top of its receptacle 11 under the action of the spring 24 mounted on its body. Advantageously, the device can be dimensioned so that the spring 24 places the element 10 in an upper equilibrium position in which the toothed wheel 8 meshes only with the teeth of the sleeve 26 of the adjustable stop 16 of the first spring 6 (position shown on FIG. 10).

The control element 10 can then be pivoted with help of an adjustment element as described above, so as to adjust the tare of the spring 6 concerned.

If the other adjacent spring 6 (on the right on FIG. 4 and on the left on FIG. 10) must also be adjusted, the adjustment element can be coupled to the control element by applying on the latter a pressure toward the inside of the housing 2. The control element 10 is thus translated toward the bottom of the housing 2 down to a lower position in which the toothed wheel 8 meshes this time only with the threading of the sleeve 26 of the adjustable stop 16 of the second spring (position not shown on the Figures for concision purposes). To this effect, the housing 2 can form a stop for the control element 10 limiting its movement toward the inside of the housing 2, in the area of this lower position.

When the tare of both springs has been adjusted, the blocking center pop screw 15 can be tightened again to ensure a stable adjustment of the springs 6. The system can be dimensioned so that, starting form an upper equilibrium position, the tightening of the center pop screw causes the automatic translation of the control element 10 toward the deactivated position. For example, the blocking screw 15 can cooperate with inclined planes formed by the groove 17 of the body of the control element 10.

Thus, while having a simple and inexpensive construction, the control device according to the invention makes it possible, within a reduced volume, to ensure a simple and reliable adjustment of the valve springs. Of course, the invention is not limited to the embodiment described above.

The invention claimed is:

1. Device for actuating at least one pair of valves of an internal combustion engine disposed in a housing of the type comprising, for each valve, magnetizing means, at least one spring acting on the valve toward an equilibrium position and comprising a fixed end made integral with an adjustable stop and a movable end made integral in translation with the valve, the adjustable stop comprising meshing means adapted to cooperate with mating meshing means of a control element to enable the movement of the stop with respect to the housing, so as to adjust the tare of the spring, wherein the control element is placed in a permanent manner in the housing in a manner adjacent to the adjustable stops of the two valves of a same pair, the housing comprising means for guiding and positioning the control element selectively in two positions meshing with the two adjustable stops respectively.

2. Device according to claim 1, wherein the two adjustable stops of a pair of valves are located in distinct planes shifted along a direction of the main movement of the control element.

3. Device according to claim 1, wherein it comprises means for blocking the control element in a deactivated position preventing the movement of an adjustable stop.

4. Device according to claim 3, wherein the deactivated position corresponds to a simultaneous meshing of the control element with the two adjustable stops of a pair of valves.

5. Device according to claim 3 wherein the means for blocking the element comprise an axle movable in the housing adapted to cooperate with the body of the control element.

6. Device according to claim 1, wherein the control element is mounted in a sliding manner in the housing.

7. Device according to claim 6, wherein the sliding direction of the control element is substantially parallel to the directions of the movements of the valves.

8. Device according claim 1, wherein the stop and the control element cooperate by meshing during their respective rotations, and in that, when the control element is in a meshing position, the respective rotation axes of the stops and of the control element are substantially parallel.

9. Device according to claim 1, wherein the stop comprises a threaded ring mounted on the outside threading of a sleeve equipped with the meshing means, the sleeve being mounted free in rotation and blocked in translation with respect to the housing, and in that the threaded ring is blocked in rotation with respect to the housing, so that the rotation of the sleeve triggers the movement of the threaded ring along said sleeve.

10. Device according to claim 9, wherein the sleeve has a general shape of a cylindrical tube, and end of which comprises a flange, and in that the meshing means are formed on the flange.

11. Device according to claim 1, wherein the guiding and positioning means comprise elastic means acting on the control element toward one of the meshing positions.

12. Device according to claim 1, wherein the control element comprises a body in the shape of a rod and a toothed wheel formed in the area of one of the ends of the body.

13. Device according to claim 1, wherein the control element has an end substantially flush in the area of a face of the housing and comprising means for coupling with an adjustment element.

14. Device according to claim 1, which comprises, for each valve, a paddle made integral in translation with the rod of the valve, the paddle being disposed between two magnetizing means, and two antagonistic springs acting on the valve/paddle group toward an equilibrium position.

15. Internal combustion engine equipped with at least a pair of valves, which comprises an actuating device according to claim 1.

* * * * *